US006006665A

United States Patent [19]

Stuchlik et al.

[11] Patent Number: 6,006,665

[45] Date of Patent: Dec. 28, 1999

[54] PLIABLE ANILOX ROLLER

[75] Inventors: Terence J. Stuchlik; David J. Rotole, both of Emporia, Kans.

[73] Assignee: Didde Web Press Corporation, Emporia, Kans.

[21] Appl. No.: 08/961,343

[22] Filed: Oct. 30, 1997

[51] Int. Cl.[6] ..... F41F 1/46; F41F 9/06

[52] U.S. Cl. ..... 101/352.13; 101/375; 101/142

[58] Field of Search ..... 101/375, 376, 101/389.1, 348, 349.1, 350.1, 350.3, 350.4, 350.5, 351.7, 352.1, 352.11, 352.13, 367, 141, 142, 450.1, 130

[56] References Cited

U.S. PATENT DOCUMENTS

| | | | |
|---|---|---|---|
| 3,467,009 | 9/1969 | Ross | 101/348 |
| 3,661,079 | 5/1972 | Stapleford | 101/142 |
| 3,678,852 | 7/1972 | Feinleib et al. | 101/450.1 |
| 4,005,654 | 2/1977 | Gundlach | 101/352.13 |
| 4,407,196 | 10/1983 | Matalia | 101/142 |
| 4,538,518 | 9/1985 | Dahlgren | 101/352.11 |
| 4,903,597 | 2/1990 | Hoage et al. | 101/375 |
| 5,005,476 | 4/1991 | Köbler et al. | 101/363 |
| 5,099,759 | 3/1992 | Sonobe et al. | 101/348 |
| 5,125,341 | 6/1992 | Yaeso | 101/367 |
| 5,154,602 | 10/1992 | Harrison | 101/351.3 |
| 5,165,341 | 11/1992 | John et al. | 101/217 |
| 5,233,921 | 8/1993 | John | 101/352.13 |
| 5,289,772 | 3/1994 | Kohara et al. | 101/351.3 |
| 5,615,611 | 4/1997 | Puschnerat | 101/363 |
| 5,778,775 | 7/1998 | Schäfer | 101/350.1 |
| 5,782,181 | 7/1998 | Rossini | 101/375 |

OTHER PUBLICATIONS

Chambon–Maquinas De Empressao E Embalagens LTDA Brochure; "World Premiere—Chambon—a new generation of offset presses", Oct. 1976.

*Primary Examiner*—Eugene Eickholt
*Attorney, Agent, or Firm*—Hovey, Williams, Timmons & Collins

[57] ABSTRACT

A printing press includes an anilox roller having a rigid inner core and a replaceable, resilient, pliable sleeve having ink cells defined in the outer surface thereof. The anilox roller rotates in contact with two spaced doctor blades defining an opening into an ink reservoir whereby cells receiving ink enabled by a rotating ink roller within the reservoir. The anilox roller engages the plate cylinder of the press forming a nip therebetween for delivery of ink to the image areas of the plate. The invention finds utility in lithographic, flexographic, offset, gravure and letter press printing.

48 Claims, 3 Drawing Sheets

2/3

12
14
16
18
28
30
32
34
40
42
44
46
54
62
64
66
68
70
72
74
76
78
80
82
84
86
88
90
92
94
96
98
100
102
104
106
108
110
111
112
114
115
116
118
120
124
126
128
130

PLIABLE ANILOX ROLLER

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention relates to the field of printing presses. In particular, the invention is concerned with a printing press including an anilox roller having a rigid inner core and a replaceable, resilient, pliable sleeve having ink cells defined in the outer surface thereof.

2. Description of the Prior Art

The prior art discloses printing presses using an anilox roller having a very hard outer surface with ink cells defined therein. In these presses, the anilox roller receives ink from a source thereof into the ink wells and a doctor blade rides against the outer surface of the anilox roller to scrape the surface clear of ink so that only the cells carry ink from the reservoir to an adjacent form roller.

The use of the anilox roller eliminates the need for ink keys and thereby simplifies the ink train and make ready time. However, these prior art anilox rollers are expensive and the hard surface abrades the doctor blade leading to frequent adjustment and replacement. Moreover, such anilox rollers cannot be used in contact with a plate cylinder as the anilox abrades the plate. Those skilled in the art also appreciate many other disadvantages and problems with the anilox rollers of the prior art.

SUMMARY OF THE INVENTION

The present invention solves the prior art problems discussed above and provides a distinct advance in the state of the art. In particular, the anilox roller of the present invention is economical to manufacture, minimizes abrasion with adjacent surfaces during rotation, and can be used in direct contact with a plate cylinder.

The preferred printing press in accordance with the present invention includes an ink source, a rotatable plate cylinder, a rotatable anilox roller, means positioning the anilox roller in ink-receiving relationship with the ink source and in ink-delivery relationship with the plate cylinder, and means for delivering ink from the plate cylinder in the substrate. The preferred anilox roller includes a rigid inner core and an outer portion in the nature of a tight-fitting sleeve over the core presenting a smooth outer surface composed of resilient, pliable material with ink cells defined therein.

The sleeve includes an inner layer and an outer layer presenting different levels of pliability with the outer layer presenting a hardness of greater durometer. The anilox roller also includes air passages for delivering compressed air between the inner core and sleeve in order to expand the sleeve for installation and removal from the inner core. Other preferred aspects of the present invention are disclosed herein.

DETAILED DESCRIPTION OF THE PREFERRED EMBODIMENT

Figure 1:
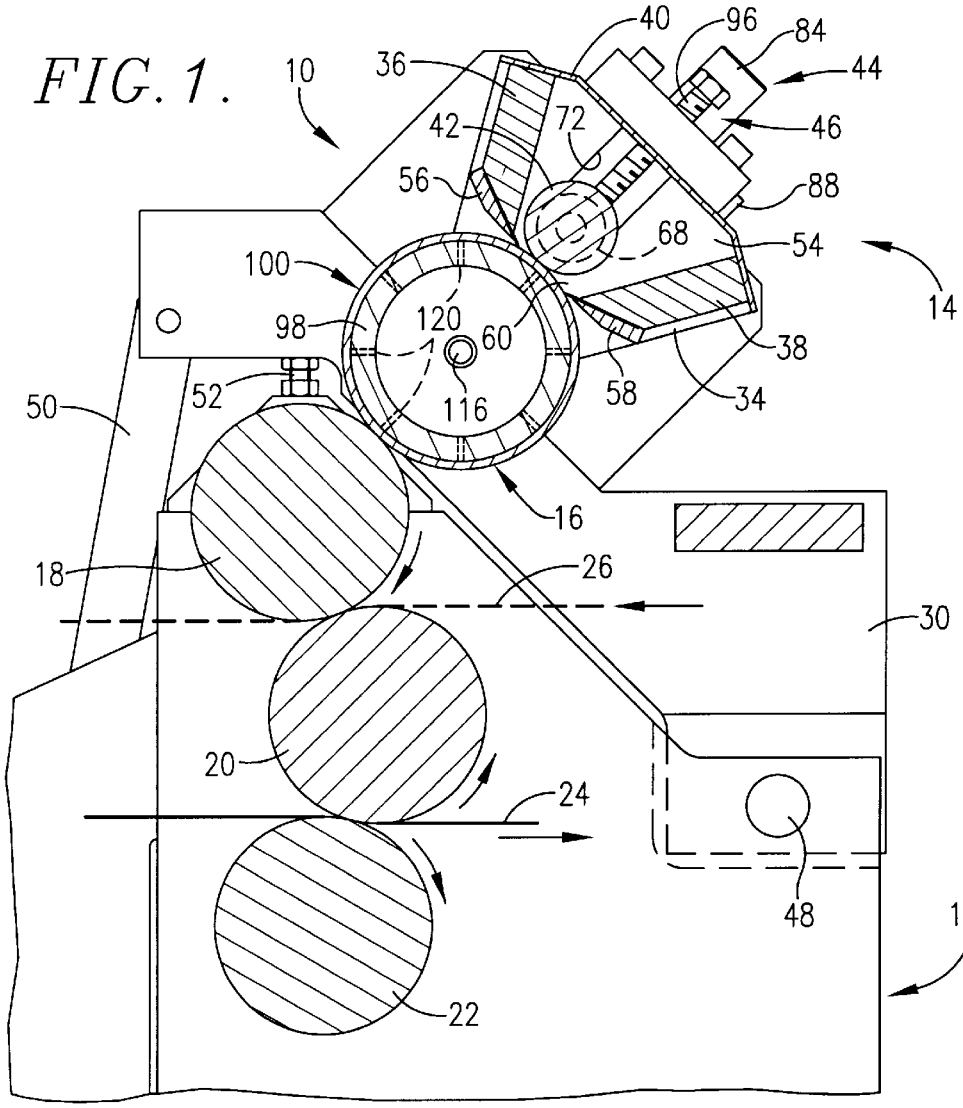
FIG. 1 is a fragmentary side elevational view in partial section of the preferred printing press in accordance with the present invention.

FIG. 1 illustrates preferred printing press 10 in accordance with the present invention. In pertinent part, printing press 10 includes housing 12 supporting ink supply assembly 14 as the preferred ink source, rotatable anilox roller 16, plate cylinder 18, blanket cylinder 20 and impression roller 22. FIG. 1 illustrates substrate 24 passing in the nip between blanket cylinder 20 and impression roller 22. FIG. 1 further illustrates substrate 26 in dashed lines passing in the nip between plate cylinder 18 and blanket cylinder 20, which is functioning as an impression roller in an alternative mode of use for press 10 as discussed further herein.

Figure 2:
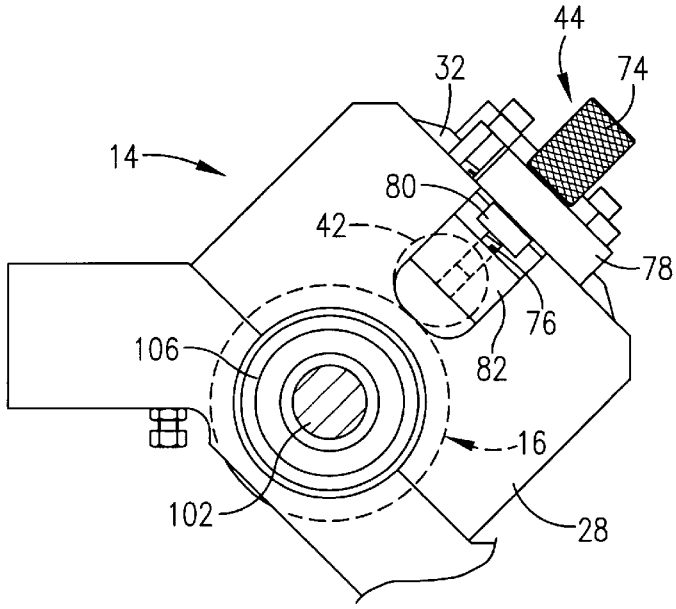
FIG. 2 is a fragmentary side elevational view of the ink supply assembly of FIG. 1.
Figures 3, 7:
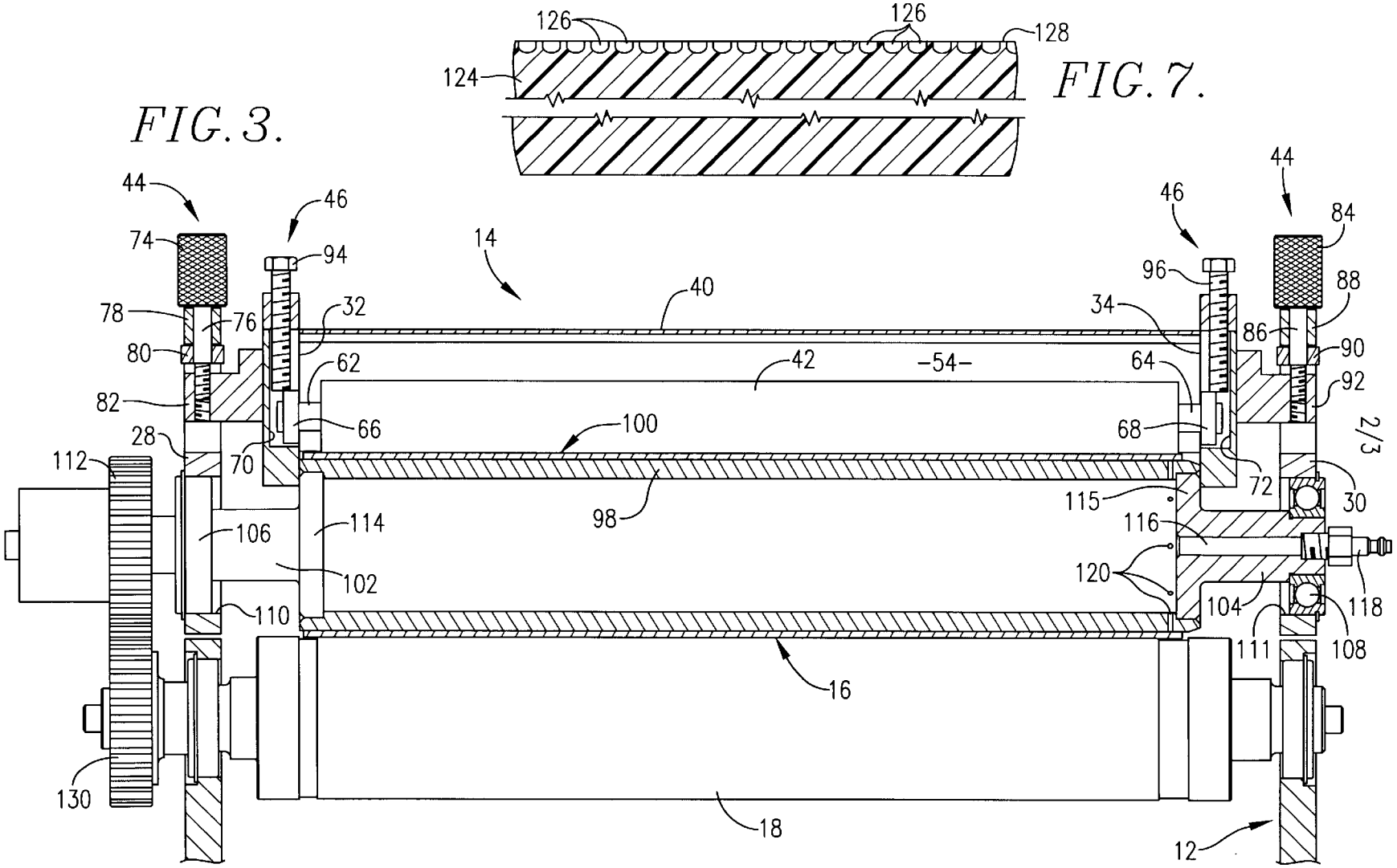
FIG. 3 is a partial front elevational view in partial section of the printing press of FIG. 1.
FIG. 7 is a fragmentary front sectional view of the outer layer of the sleeve of the anilox roller of FIG. 4.
Figure 4:
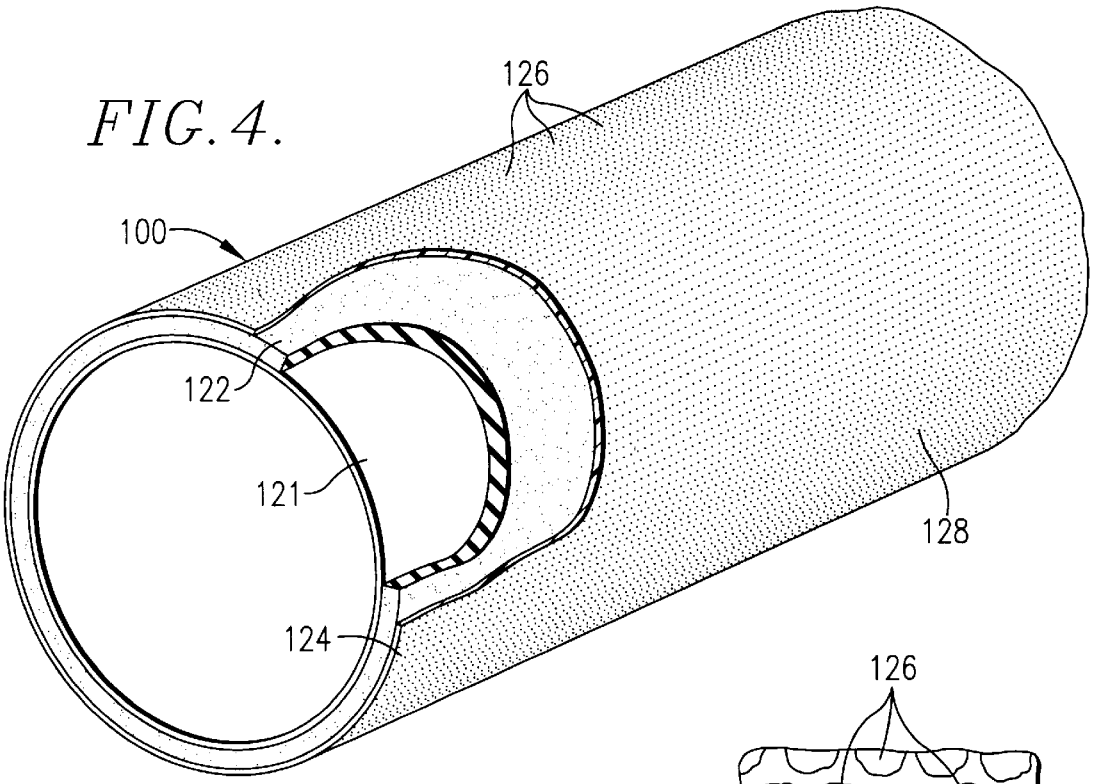
FIG. 4 is a partial pictorial view of the preferred anilox roller of FIG. 1 with portions cut away for clarity of illustration.
Figure 6:
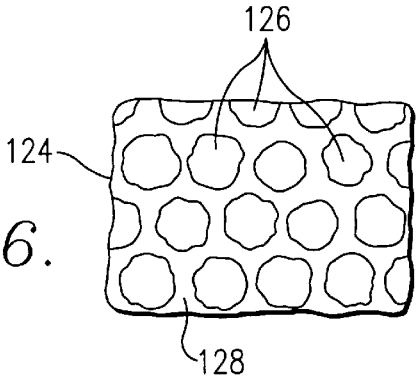
FIG. 6 is a partial exploded view of the outer surface of the anilox roller of FIG. 4.
Figure 5:
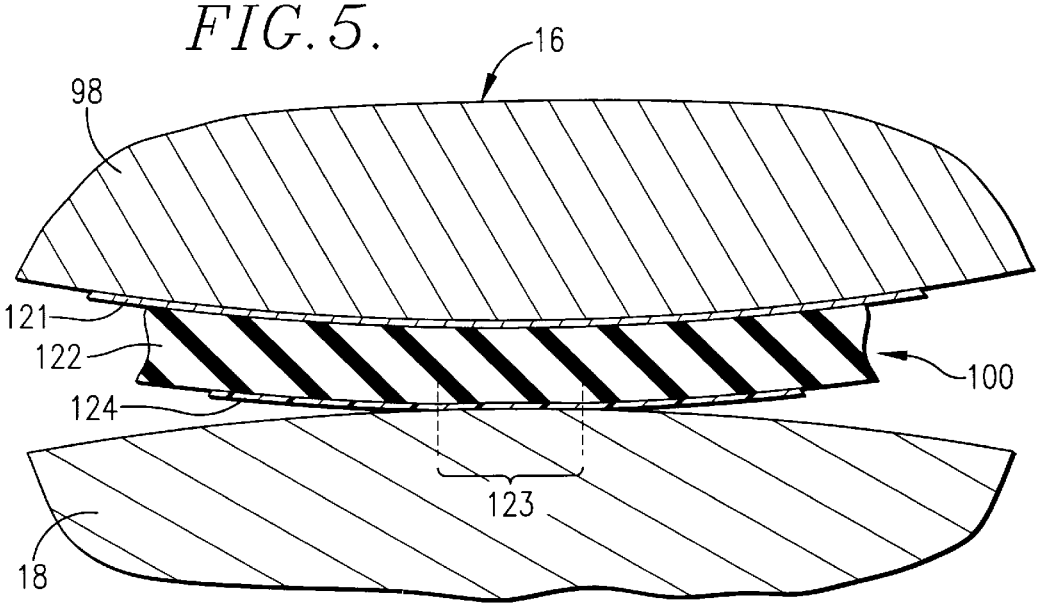
FIG. 5 is a partial side sectional view of the anilox roller and plate cylinder of FIG. 1 showing the nip therebetween.

Referring to FIGS. 1–3, ink supply assembly 14 includes opposed, spaced end plates 28 and 30 supporting on the inboard sides thereof respective, opposed, spaced end walls 32 and 34. Assembly 14 also includes opposed, spaced, angled, reservoir side walls 36 and 38, and reservoir top wall 40. Assembly 14 further includes ink roller 42, doctor blade adjustment mechanism 44, and ink roller nip adjustment mechanism 46.

As shown in FIG. 1, pivot rod 48 extends through end plate 28 and also through end plate 30 and through housing 12 for pivotally mounting assembly 14. Conventional linkage 50 is pivotally coupled with end plate 30 for shifting assembly 14 about pivot rod 48 in order to shift anilox roller 16 toward and away from plate cylinder 18. Adjustable threaded stop 52 is positioned between end plate 30 and housing 12 for defining the limit of travel of assembly 14 toward plate cylinder 18 and thereby defines the amount of nip between anilox roller 16 and plate cylinder 18.

As illustrated, end walls 32, 34, side walls 36, 38 and top wall 40 cooperatively define ink reservoir 54. Side walls 36, 38 include respective doctor blades 56 and 58 coupled therewith opposite top wall 40 and define reservoir opening 60 therebetween. Opening 60 is configured for receiving a portion of anilox roller 16 therein and thereby into reservoir 54 for placing roller 16 in contact with blades 56, 58 and in ink-receiving relationship with ink supply assembly 14.

Ink roller 42 is positioned in reservoir 54 and extends between end walls 32, 34 adjacent opening 60 for rotatable contact with anilox roller 16. The respective ends of ink roller 42 include roller shafts 62 and 64 with respective bearings 66 and 68 coupled therewith and received in corresponding bearing recesses 70 and 72 defined on the inboard sides of end walls 32, 34. Bearings 66, 68 rotatably mount ink roller 42 in reservoir 54.

Doctor blade adjustment mechanism 44 includes knurled nob 74 with rod 76 extending therefrom. Rod 76 is rotatably received through support piece 78 supported on end plate 28, received through collar 80 and fixed thereto, and threadably received in block 82 extending outwardly from end wall 32. Similarly, knurled knob 84 presents rod 86 extending therefrom with rod 86 rotatably received through support piece 88 supported on end plate 30, received through collar 90 and fixed thereto, and threadably received in block 92 extending outwardly from end wall 34. Knobs 74 and 84 are manually adjusted to shift assembly 14 and thereby doctor blades 56, 58 toward and away from anilox roller 16. Axial rotation of knobs 74 and 84 on block 82 and 92 respectively allows increased or decreased pressure on front or rear doctor blade.

Ink roller nip adjustment mechanism 46 includes bolt 94 threadably received in end wall 32 and positioned so that the end of bolt 94 engages ink roller bearing 66. Similarly, bolt 96 is threadably received in end wall 34 and positioned so that the end of bolt 94 engages ink roller bearing 68. Bolts 94, 96 are adjusted as needed for the desired amount of nip between ink roller 42 and anilox roller 16.

Anilox roller 16 includes inner core 98 and outer portion or sleeve 100. Inner core 98 is preferably composed of aluminum and includes end shafts 102 and 104 extending respectively through bearings 106 and 108 received in bearing recesses 110 and 111 defined in respective end plates 28 and 30. As shown in FIG. 3, the exposed end of shaft 102 includes gear 112 coupled therewith on the outboard side of bearing 106. Inner core 98 presents a tubular configuration with the left end thereof sealed by the fit of flange 114 of end shaft 102. End shaft 104 includes flange 115 fitted in the right end of core 98 and includes compressed air passage 116 defined therein with compressed air fitting 118 threadably coupled in passage 116 at the exposed end of shaft 104. Core 98 further includes a plurality of compressed air ports 120 defined therethrough around the periphery adjacent the inboard side of flange 114. This allows compressed air entering through fitting 118 to pass from the interior of core 98 to the outer surface thereof for inflating sleeve 100 for installation and removal thereof.

Sleeve 100 presents a nominal outer diameter of about 3.821 inches and a face length of about 18.75 inches. Sleeve 100 includes a nickel base layer or mandrel 121, an inner layer 122 and an outer layer 124. Inner layer 122 is preferably composed of 50 durometer elastic material having a thickness of between about 0.015" and 0.0125". Outer layer 124 is preferably composed of 90 durometer polymer between about 0.003" and 0.010" thick. This polymer material is harder and more durable than the rubber of inner layer 122 while thin enough to retain the resilient and pliable nature of inner layer 122.

A plurality of ink cells 126 are defined in outer surface 128 which is the exposed surface of outer layer 124. Cells 128 are laser formed and present a generally circular cross-sectional configuration with a diameter ranging between 20 and 64 microns and a depth between 3 and 60 microns depending upon the particular application. Additionally, cells 126 are arranged in staggered lines with between about 50 and 1200 cells per inch with a preferred range between about 300 and 500 cells per inch for different sleeves 100.

Sleeve 100 is manufactured by coating the nickel mandrel 121 with the desired thickness of elastic material and then polymer 124. The assembly is then baked at 275° for 12 hours. After cooling, conventional laser techniques are used to create cells 126 in outer layer 124. Compressed air is then injected into the mandrel which expands sleeve 100 allowing it to be removed and then installed on a desired inner core 98 to form anilox roller 16 for subsequent placement and use in printing press 10.

For greater utility, a number of different anilox roller sleeves 100 would be available for press 100 with a variety of different configurations of cells 126. For example, for a lithography application, a cyan standard density of 1.3 can be generally achieved with about 400 cells per inch with a cell depth of 44 microns and a diameter of 53 microns. Ink density is inversely proportioned to the number of cells per inch. That is, the higher the number of cells, the lower the density.

Plate cylinder 18 is conventional in nature and includes gear 130 extending from the shaft thereof meshed with gear 112 of anilox roller 16. Cylinder 18 includes a conventional printing plate thereon such as that used in offset, lithographic, flexographic and letter press along with others.

In the use of printing press 10, linkage 50 is operated to pivot ink supply assembly 14 and anilox roller 16 about pivot rod 48 away from plate cylinder 18. The desired printing plate is installed on plate cylinder 18.

Next, with anilox roller 16 removed, the desired sleeve 100 is installed on inner core 98. This is accomplished by coupling a compressed air hose with an air supply at about 100 psi with fitting 118. The compressed air travels through passage 116, through the interior of core 98 and through ports 120. A selected sleeve 100 can then be placed over core 98 with the compressed air keeping sleeve 100 inflated. When sleeve 100 is properly positioned, the compressed air is released and sleeve 100 shrinks to a tight fit over core 98.

Next, linkage 50 is operated to rotate ink supply assembly 14 along with anilox roller 16 into contact with plate cylinder 18. It is preferred that stop 52 be adjusted so that the nip between anilox roller 16 and plate cylinder 18 is about 3/32". That is, outer surface 128 of sleeve 100 flexes and conforms to the surface of plate cylinder 18 to produce an area of contact 123 about 3/32" wide along the lengths of roller 16 and cylinder 18.

Knurled knobs 74 and 84 are then adjusted to place doctor blades 56, 58 in contact with outer surface 128. Next, bolts 94, 96 are adjusted so that there is a nip of about 5/32" between ink roller 42 and anilox roller 16. The preferred width of the nip is about 5/32".

In operation, that portion of anilox roller 16 extending through opening 60 into ink reservoir 54 is in contact with the ink therein. The mutual rotation between ink roller 42 and anilox roller 16 and the nip therebetween ensures that cells 126 are filled with ink. Doctor blade 56 scrapes outer surface 128 free of ink leaving only cells 126 carrying ink to plate cylinder 18.

As anilox roller 16 rotates into contact at the nip with plate cylinder 18, the ink is released from cells 126. The slight compression of cells 126 in the nip ensures good contact between the ink and the plate so that the ink is retained by the plate. Blades 56 and 58 also provide an ink seal.

FIG. 1 illustrates an offset, lithographic printing configuration in which the ink from plate cylinder 18 is transferred to blanket cylinder 20 for subsequent transfer to substrate 24 moving between blanket cylinder 20 and impression roller 22. In this mode, it is preferred that the plate on cylinder 18 is a so-called waterless plate such as the TORAY waterless offset plate. In this way, the need for a water delivery system is eliminated vastly simplifying the mechanical components of press 10.

Printing press 10 can also be operated in a direct printing mode in which the printing plate is in direct contact with the substrate. This mode is illustrated in FIG. 1 by substrate 26 in dashed lines. In this mode, the plate would be a flexographic, letter press or gravure plate and the rotation of the rollers and cylinders would be reversed. In this mode, blanket cylinder 20 would function as the impression roller and roller 22 would be unused.

As those skilled in the art will now appreciate, the present invention presents a printing press and anilox roller that is vastly simplified and versatile compared to the prior art. The pliability of the preferred anilox roller enables direct contact with the plate cylinder without excessive wear on either component. In so doing, the need is eliminated for form rollers and vibration rollers. The anilox roller also eliminates the need to set density across the page by conventional ink keys. Moreover, by use of the preferred waterless plate, prior art water systems are also eliminated thereby avoiding the attendant problems with such systems.

Those skilled in the art will also appreciate that the present invention encompasses many variations in the preferred embodiments herein and having thus described these embodiments, the following is claimed as new and desired to be secured by Letters Patent:

We claim:

1. A printing press comprising:

an ink source;

a rotatable plate cylinder;

a rotatable anilox roller;

means positioning said anilox roller in direct ink-receiving relationship with said ink source and in ink-delivery, direct engaging, relationship with said plate cylinder; and delivery means for delivering ink from said plate cylinder to a substrate, said anilox roller including an outer layer portion composed of resilient, pliable material presenting a smooth outer surface and having structure defining a plurality of ink cells in said outer surface portion for receiving ink from said ink source during rotation of said anilox roller and for delivering ink so received directly onto said plate cylinder during mutual rotation therewith, and said ink source including at least one doctor blade having an outer edge in contacting engagement with the smooth outer surface of the anilox roller, said doctor blade being located in disposition and operable to cause the outer edge to scrape said outer surface of the anilox roller free of ink leaving ink on the anilox roller only in the cells thereof for delivery to the plate cylinder.

2. The printing press as set forth in claim 1, said ink source including structure defining an ink reservoir and a roller-receiving opening presenting opposed sides with a portion of said anilox roller received in said opening between said sides and including sealing means sealing said opening against said anilox roller.

3. The printing press as set forth in claim 2, said sealing means including at least one doctor blade positioned along one of said sides and engaging said outer surface of said anilox roller.

4. The printing press as set forth in claim 3, said sealing means further including second doctor blade positioned along the other of said sides and engaging said outer surface of said anilox roller.

5. The printing press as set forth in claim 4, said ink source including blade adjusting means for adjusting said doctor blades toward and away from said anilox roller.

6. The printing press as set forth in claim 5, said blade adjusting means including an adjusting mechanism for shifting and rotating said ink source and thereby said doctor blades toward and away from said anilox roller.

7. The printing press as set forth in claim 3, said ink source including blade adjusting means for adjusting said doctor blade toward and away from said anilox roller.

8. The printing press as set forth in claim 7, said blade adjusting means including an adjusting mechanism for shifting said ink source and thereby said doctor blade toward and away from said anilox roller.

9. The printing press as set forth in claim 1, said ink source including a rotatable ink roller positioned within said reservoir in contact with said anilox roller and rotatable therewith for ensuring filling of said cells with ink.

10. The printing press as set forth in claim 9, said ink source further including ink roller adjusting means for adjusting said ink roller toward and away from said anilox roller.

11. The printing press as set forth in claim 1, said printing press being a flexographic press and with said plate cylinder having a flexographic plate mounted thereon.

12. The printing press as set forth in claim 1, said printing press being a letter press and with said plate cylinder having a letter press mounted thereon.

13. The printing press as set forth in claim 1, said printing press being an offset press and including a rotatable blanket cylinder engaging said plate cylinder, and an impression roller adjacent the blanket cylinder for printing a substrate between the blanket cylinder and the impression cylinder.

14. The printing press as set forth in claim 1, said plate cylinder including a waterless lithographic printing plate mounted thereon.

15. The printing press as set forth in claim 1, said anilox roller and said plate cylinder presenting a nip therebetween having a width between about 1/32" and 1/4".

16. The printing press as set forth in claim 1, said anilox roller including between about 50 and 1200 cells per inch.

17. The printing press as set forth in claim 1, said cells being arranged in lines of cells parallel or pattern to the axis of said anilox roller and extending around the periphery thereof.

18. The printing press as set forth in claim 1, said cells presenting a generally circular cross-sectional configuration and being between about 20 and 64 microns in diameter.

19. The printing press as set forth in claim 1, said cells being between about 3 and 60 microns in depth.

20. The printing press as set forth in claim 1, said anilox roller including a rigid inner core circumscribed by said outer portion.

21. The printing press as set forth in claim 20, said outer portion being a sleeve fitted over said inner core.

22. The printing press as set forth in claim 21, said anilox roller including air passages configured for receiving compressed air from a source thereof and for delivering said compressed air to the juncture between said sleeve and core for expanding said sleeve in order to allow installation and removal of said sleeve relative to said core.

23. The printing press as set forth in claim 22, said sleeve being sized for tightly engaging said core in the absence of compressed air therebetween.

24. The printing press as set forth in claim 1, said outer portion including an inner layer and an outer layer presenting said surface.

25. The printing press as set forth in claim 24, said inner layer being composed of elastic material.

26. The printing press as set forth in claim 25, said inner layer presenting a hardness of between about 30 and 60 durometer.

27. The printing press as set forth in claim 25, said inner layer being about 0.050" thick.

28. The printing press as set forth in claim 24, said outer layer being composed of polymer.

29. The printing press as set forth in claim 28, said outer layer presenting a hardness of between about 70 and 100 durometer.

30. The printing press as set forth in claim 29, said outer layer being about 0.004" thick.

31. The printing press as set forth in claim 1, said ink source including structure defining an ink reservoir and a pair of spaced doctor blades defining a roller-receiving opening therebetween with a portion of said anilox roller received in said opening and with said outer surface engaging said doctor blades, a blade adjusting mechanism for shifting said ink source and thereby said doctor blades toward and away from said anilox roller, a rotatable ink roller positioned within said reservoir in contact with said anilox roller and rotatable therewith for ensuring filling of said cells with ink, and ink roller adjusting means for adjusting said ink roller toward and away from said anilox roller.

32. The printing press as set forth in claim 31, said anilox roller and said plate cylinder presenting a nip therebetween having a width between about 1/32" and 1/4".

33. The printing press as set forth in claim 32, said anilox roller including between about 50 and 1200 cells per inch arranged in lines of cells parallel to the axis of said anilox roller and extending around the periphery thereof, said cells presenting a generally circular cross-sectional configuration and being between about 20 and 64 microns in diameter and between about 3 and 60 microns in depth.

34. The printing press as set forth in claim 33, said anilox roller including a rigid inner core circumscribed by said outer portion, said outer portion being a sleeve fitted over said inner core, and structure defining air passages configured for receiving compressed air from a source thereof and for delivering said compressed air to the juncture between said sleeve and core for expanding said sleeve in order to allow installation and removal of said sleeve relative to said core, said sleeve being sized for tightly engaging said core in the absence of compressed air therebetween and including an inner layer and an outer layer presenting said surface.

35. The printing press as set forth in claim 34, said inner layer being composed of elastic material, presenting a hardness of between about 30 and 60 durometer, and being about 0.050" thick, said outer layer being composed of polymer, presenting a hardness of between about 70 and 100 durometer, and being about 0.004" thick.

36. The printing press as set forth in claim 1 further including means for selectively shifting said ink source in and out of contact with said anilox roller.

37. An anilox roller for use in a printing press, the printing press including an ink source, a rotatable plate cylinder, means for positioning said anilox roller in direct ink-receiving relationship with the ink source and in ink-delivery, direct engaging relationship with the plate cylinder, and means for delivering ink from the plate cylinder to the substrate, said anilox roller comprising:

a rigid inner core; and a sleeve fitted over said inner core composed of resilient, pliable material and having structure defining a plurality of ink cells in said surface for receiving ink from the ink source during rotation and for delivering ink so received directly onto said blanket cylinder during mutual rotation therewith, said sleeve including an outer layer in which said cells are formed and an inner supporting layer for the outer layer composed of elastic material, the material of said inner layer being more pliable than the material of said outer layer.

38. The anilox roller as set forth in claim 37, said anilox roller including between about 50 and 1200 cells per inch.

39. The anilox roller as set forth in claim 37, said cells being arranged in lines of cells parallel to the axis of said anilox roller and extending around the periphery thereof.

40. The anilox roller as set forth in claim 37, said cells presenting a generally circular cross-sectional configuration and being between about 20 and 64 microns in diameter.

41. The anilox roller as set forth in claim 37, said cells being between about 3 and 60 microns in depth.

42. The anilox roller as set forth in claim 37, said anilox roller including air passages configured for receiving compressed air from a source thereof and for delivering said compressed air to the juncture between said sleeve and core for expanding said sleeve in order to allow installation and removal of said sleeve relative to said core.

43. The anilox roller as set forth in claim 42, said sleeve being sized for tightly engaging said core in the absence of compressed air therebetween.

44. The anilox roller as set forth in claim 37, said inner layer presenting a hardness of between about 30 and 60 durometer.

45. The anilox roller as set forth in claim 37, said inner layer being about 0.050" thick.

46. The anilox roller as set forth in claim 37, said outer layer being composed of polymer.

47. The anilox roller as set forth in claim 37, said outer layer presenting a hardness of between about 70 and 100 durometer.

48. The anilox roller as set forth in claim 37, said outer layer being about 0.004" thick.

* * * * *